US009561580B2

(12) United States Patent
Chen

(10) Patent No.: US 9,561,580 B2
(45) Date of Patent: Feb. 7, 2017

(54) GRINDING-DISC DEVICE FOR POWER TOOLS

(71) Applicant: PRIME SUPPLY INC., Taichung (TW)

(72) Inventor: Wen-Pin Chen, Taichung (TW)

(73) Assignee: Prime Supply Inc., Taichung (TW)

( * ) Notice: Subject to any disclaimer, the term of this patent is extended or adjusted under 35 U.S.C. 154(b) by 509 days.

(21) Appl. No.: 14/200,626

(22) Filed: Mar. 7, 2014

(65) Prior Publication Data

US 2015/0251295 A1 Sep. 10, 2015

(51) Int. Cl.

| | |
|---|---|
| ***B24D 13/20*** | (2006.01) |
| ***B24B 45/00*** | (2006.01) |
| ***B24D 9/08*** | (2006.01) |
| *B24D 7/16* | (2006.01) |

(52) U.S. Cl.

CPC ..... *B24D 13/20* (2013.01); *B24B 45/00* (2013.01); *B24B 45/006* (2013.01); *B24D 9/08* (2013.01); *B24D 7/16* (2013.01)

(58) Field of Classification Search

CPC ..... B24B 45/00; B24B 45/003; B24B 45/006; B24B 23/02; B24D 13/20; B24D 9/08; B24D 7/16

See application file for complete search history.

(56) References Cited

U.S. PATENT DOCUMENTS

| | | | | |
|---|---|---|---|---|
| 4,182,615 | A * | 1/1980 | Weissman | B24B 27/02 403/348 |
| 5,626,510 | A * | 5/1997 | Bergner | B24B 23/04 451/344 |
| 6,185,781 | B1 * | 2/2001 | Miller | B24D 13/147 15/28 |
| 2005/0170763 | A1 * | 8/2005 | Sun | B24B 23/02 451/359 |
| 2006/0172668 | A1 * | 8/2006 | Hofmann | B24B 23/02 451/359 |
| 2008/0182487 | A1 * | 7/2008 | Muller | B24D 13/18 451/53 |
| 2012/0051832 | A1 * | 3/2012 | Krause | B24B 45/006 403/27 |
| 2012/0190279 | A1 * | 7/2012 | Ficai | B24D 5/10 451/442 |

* cited by examiner

*Primary Examiner* — Monica Carter
*Assistant Examiner* — Marcel Dion
(74) *Attorney, Agent, or Firm* — Tracy M. Heims; Ruth Lynette Wylie; Apex Juris, pllc

(57) ABSTRACT

A grinding-disc device for power tools has an outer cover, a grinding tray and a grinding element. The outer cover has a casing and a mounting tube. The casing has a chamber, a connecting tube, at least one engaging hole and at least one engaging arm. The mounting tube is connected to the connecting tube. The grinding tray is detachably connected to the outer cover and has a body and at least one engaging element. The body is mounted below the casing and has a tube seat and a connecting board. The at least one engaging element is formed on the body, engages the at least one engaging arm to hold the grinding tray with the outer cover, and each one of the at least one engaging element has an engaging hook. The grinding element is detachably connected to the grinding tray below the outer cover.

20 Claims, 9 Drawing Sheets

GRINDING-DISC DEVICE FOR POWER TOOLS

BACKGROUND OF THE INVENTION

1. Field of the Invention

The present invention relates to a grinding-disc device, and more particularly relates to a grinding-disc device for power tools that can reduce the cost of use, can improve the applicability and can be used safely.

2. Description of Related Art

Generally, a power tool can be used to clean and remove rust from the surface of metal by assembling a conventional grinding-disc device on the power tool. The conventional grinding-disc device is rotated with the power tool to grind or polish the surface of the metal to provide a cleaning and rust-removing effect to the metal. The conventional grinding-disc device has a grinding tray and a grinding element. The grinding tray has a top side, a bottom side and a mounting tube. The mounting tube is formed on and protrudes from the top side of the grinding tray and is connected to the power tool. The grinding element is detachably mounted on the bottom side of the grinding tray.

The conventional grinding-disc device for the power tool can be used to grind or polish the surface of the metal. However, the grinding tray of the conventional grinding-disc device only has a single size and is connected to a grinding element with a corresponding size. When a user wants to process a workpiece (such as a wheel rim etc.) in a different size or shape, the user needs to replace or buy another grinding-disc device in another size, and this will increase the cost of using the conventional grinding-disc device and reduce the applicability of the conventional grinding-disc device. In addition, the clamping force between the mounting tube of the grinding tray and the power tool is insufficient, and the mounting tube may be separated from the power tool when the power tool is operated during a high-torque condition and this is unsafe in use.

To overcome the shortcomings, the present invention provides a grinding-disc device for power tools to mitigate or obviate the aforementioned problems.

SUMMARY OF THE INVENTION

The main objective of the present invention is to provide a grinding-disc device for power tools that can reduce the cost of use, can improve the applicability and can be used safely.

The grinding-disc device for power tools in accordance with the present invention has an outer cover, a grinding tray and a grinding element. The outer cover has a casing and a mounting tube. The casing has a chamber, a connecting tube, at least one engaging hole, and at least one engaging arm. The mounting tube is connected to the connecting tube. The grinding tray is detachably connected to the outer cover and has a body and at least one engaging element. The body is mounted below the casing and has a tube seat and a connecting board. The at least one engaging element is formed on the body, engages the at least one engaging arm to hold the grinding tray with the outer cover, and each one of the at least one engaging element has an engaging hook engaging the at least one engaging arm. The grinding element is detachably connected to the grinding tray below the outer cover.

Other objects, advantages and novel features of the invention will become more apparent from the following detailed description when taken in conjunction with the accompanying drawings.

DETAILED DESCRIPTION OF THE PREFERRED EMBODIMENT

Figure 1:
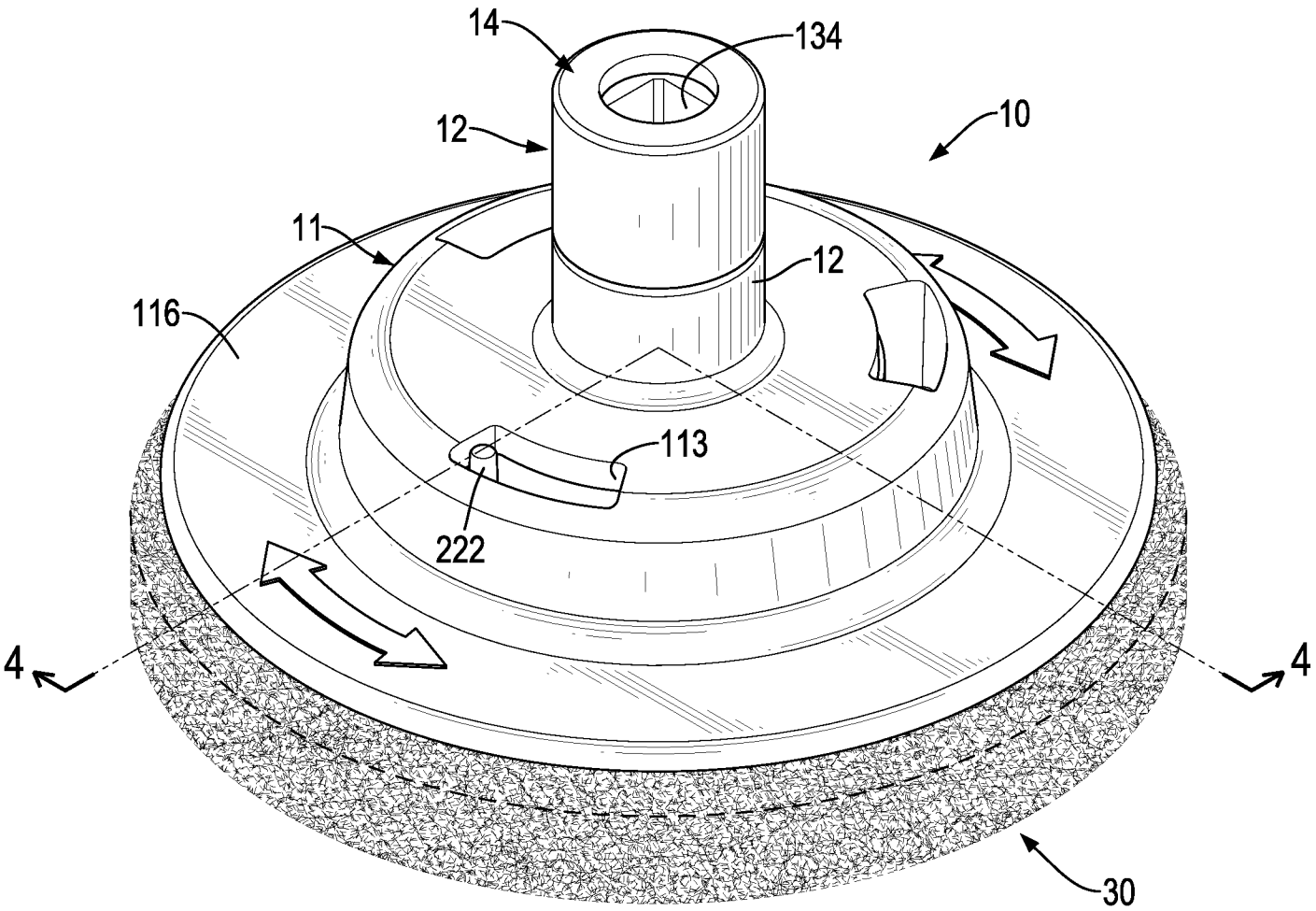
FIG. 1 is a perspective view of a first embodiment of a grinding-disc device for power tools in accordance with the present invention.
Figure 2:
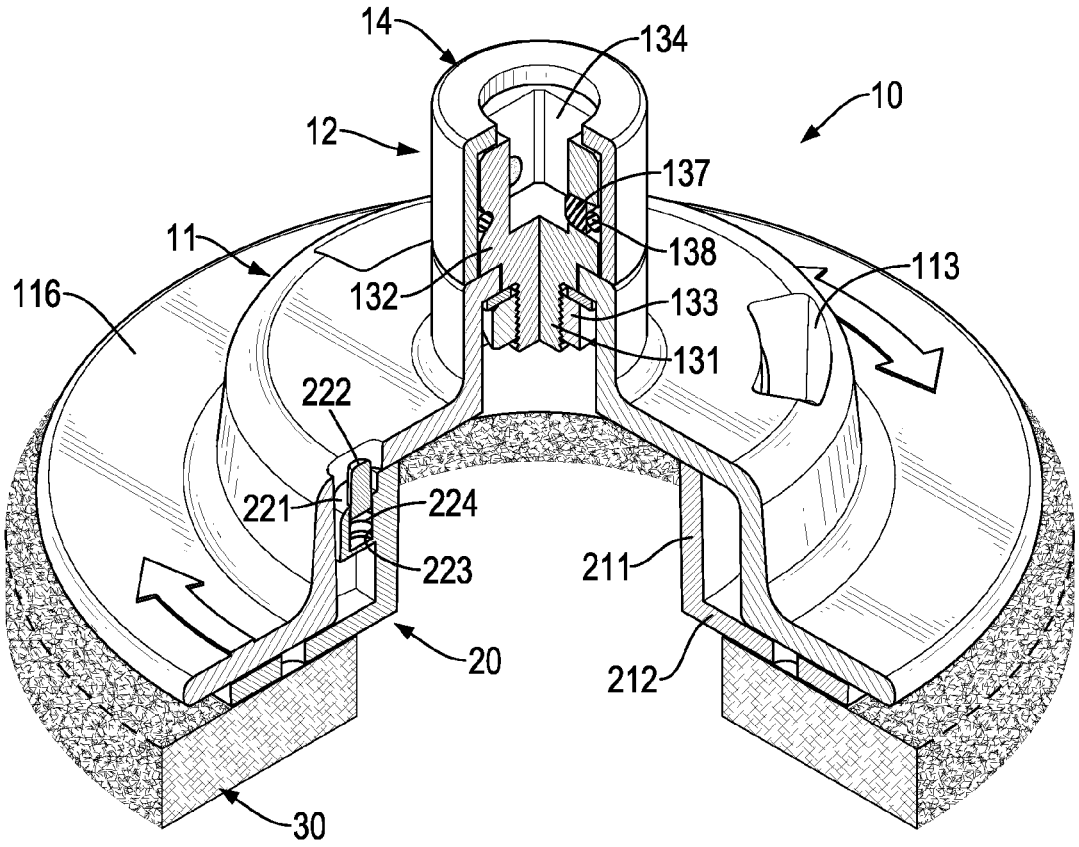
FIG. 2 is a perspective sectional view of the grinding-disc device in FIG. 1.
Figure 3:
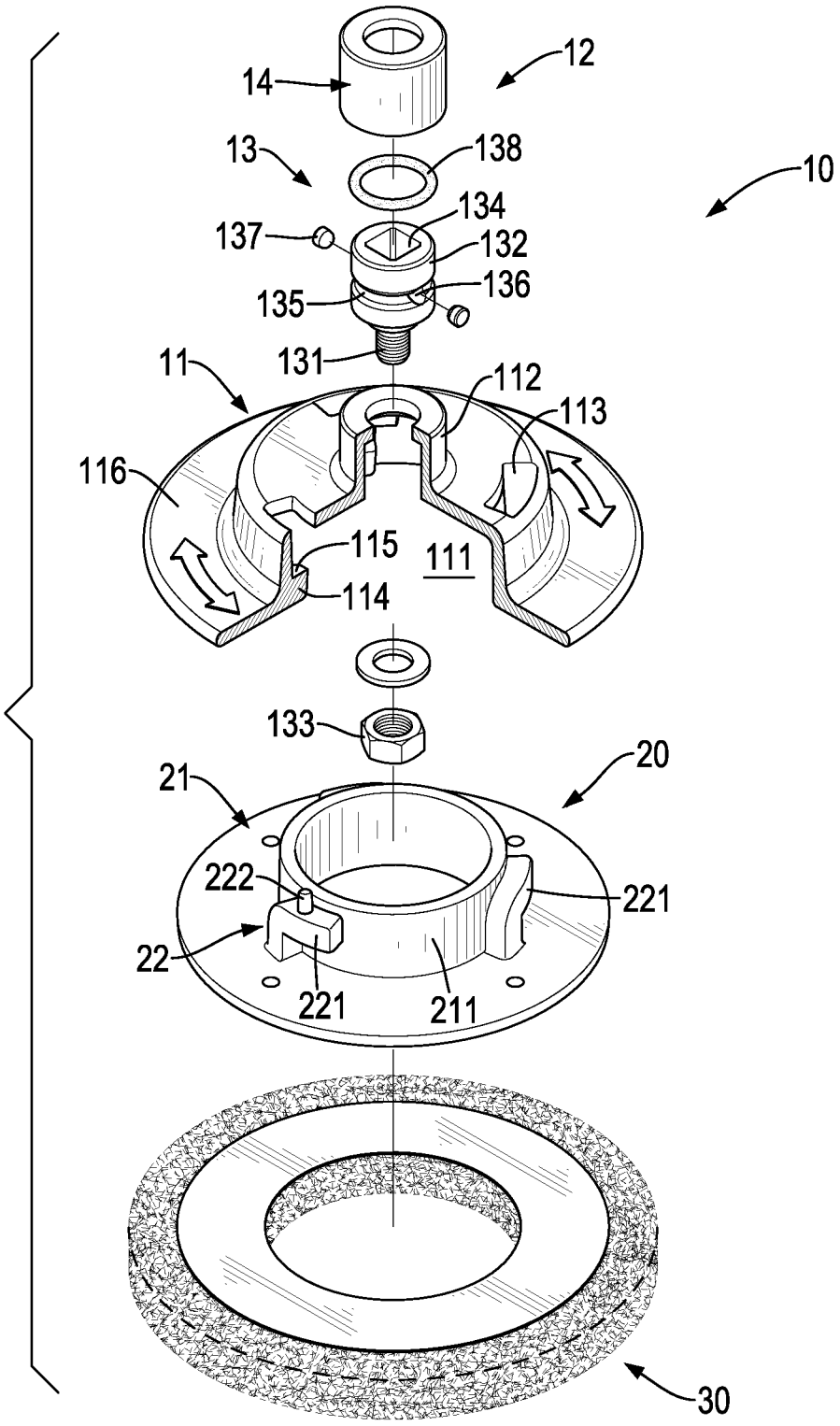
FIG. 3 is an exploded perspective view of the grinding-disc device in FIG. 1.

With reference to FIGS. 1 to 3, a first embodiment of a grinding-disc device in accordance with the present invention comprises an outer cover 10, a grinding tray 20 and a grinding element 30.

The outer cover 10 has a casing 11 and a mounting tube 12.

The casing 11 has an open bottom, a closed top, a center, an outer periphery, an internal surface, a chamber 111, a connecting tube 112, at least one engaging hole 113, at least one engaging arm 114, and an extending panel 116. The chamber 111 is formed in the casing 11 between the open bottom and the closed top of the casing 11 and communicates with the open bottom of the casing 11. The connecting tube 112 is formed on and protrudes from the closed top of the casing 11 at the center of the casing 11, communicates with the chamber 111 and has a top end. The at least one engaging hole 113 is formed through the closed top of the casing 11 and communicates with the chamber 111. Preferably, the casing 11 has three engaging holes 113 formed through the closed top of the casing 11 around the connecting tube 112 at intervals. The at least one engaging arm 114 may be L-shaped, is formed on and protrudes from the internal surface of the casing 11 near the open bottom of the casing 11, and has an engaging recess 115 formed in the internal surface of the casing 11 and aligning with the at least one engaging hole 113. Preferably, the casing 11 has three engaging arms 114 formed on and protruding from the internal surface of the casing 11 near the open bottom of the casing 11. The extending panel 116 is radially formed around the outer periphery of the casing 11 near the open bottom of the casing 11.

Figure 4:
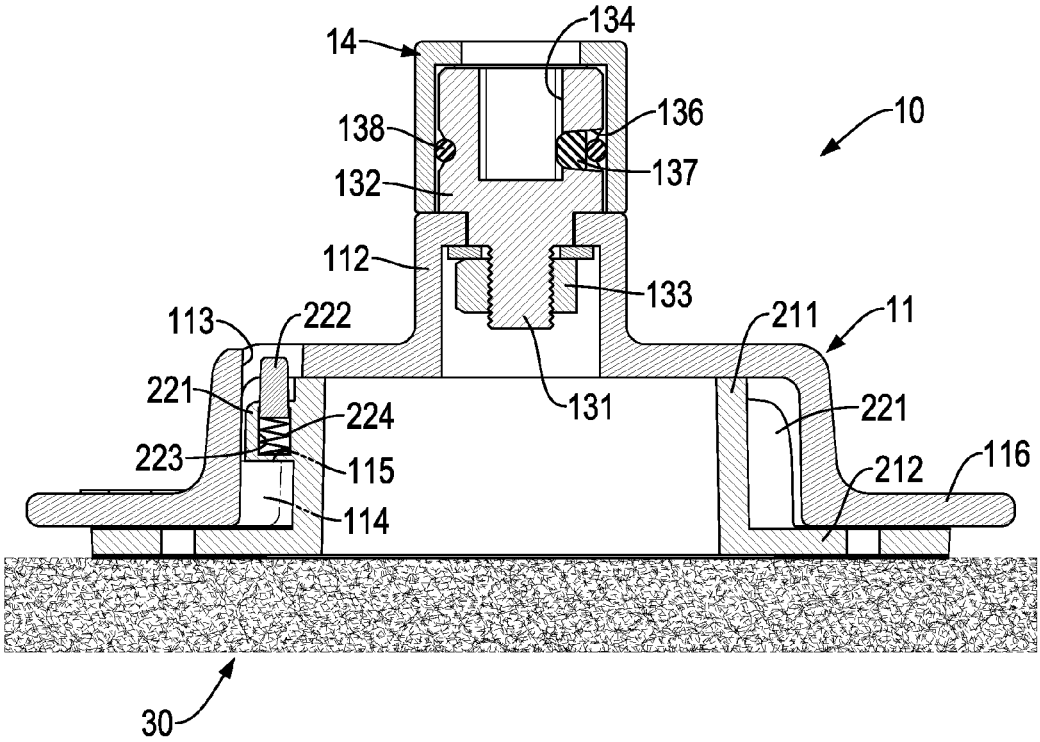
FIG. 4 is a cross sectional side view of the grinding-disc device along line 4-4 in FIG. 1.

With reference to FIGS. 3 and 4, the mounting tube 12 is connected to the connecting tube 112 of the casing 11 and has a mounting head 13 and a mounting lid 14. The mounting head 13 is connected to the connecting tube 112 of the casing 11 and has a connecting rod 131 and a connecting barrel 132. The connecting rod 131 extends into the connecting tube 112 and has a top end, a lower end, and a fastener 133. The lower end of the connecting rod 131 extends into the connecting tube 112. The fastener 133 is mounted around the connecting rod 131 and abuts against the connecting tube 112 to connect the connecting rod 131 with the connecting tube 112.

The connecting barrel 132 is formed on and axially protrudes from the top end of the connecting rod 131, is mounted above the connecting tube 112, and has a top end, an external surface, a connecting recess 134, an annular groove 135, at least two tapered holes 136, and an elastic ring 138. The connecting recess 134 may be polygonal and is axially formed in the top end of the connecting barrel 132. The annular groove 135 is formed in the external surface of the connecting barrel 132. The at least two tapered holes 136 are radially formed through the external surface of the connecting barrel 132 in the annular groove 135, communicate with the connecting recess 134, and each one of the at least two tapered holes 136 has a clamping element 137. The clamping element 137 is magnetic, is mounted in the corresponding tapered hole 136, and extends into the connecting recess 134.

The elastic ring 138 is mounted in the annular groove 135 and abuts the clamping elements 137 to hold the clamping elements 137 in the at least two tapered holes 136 to extend into the connecting recess 134. The mounting lid 14 is mounted around the connecting barrel 132 of the mounting head 13, abuts the top end of the connecting tube 112, and has an internal surface. The internal surface of the mounting lid 14 abuts the elastic ring 138 to hold the elastic ring 138 between the mounting lid 14 and the clamping elements 137 of the at least two tapered holes 136.

The grinding tray 20 is detachably connected to the outer cover 10 and has a body 21 and at least one engaging element 22. The body 21 is mounted below the casing 11 and has a tube seat 211 and a connecting board 212. The tube seat 211 is hollow, is mounted in the chamber 111 via the open bottom of the casing 11, and has a top end, a bottom end and an external surface. The top end of the tube seat 211 abuts the closed top of the casing 11. The connecting board 212 is radially formed around the external surface of the tube seat 211 at the bottom end of the tube seat 211, abuts the extending panel 116 of the casing 11, and has a top side.

The at least one engaging element 22 is formed on the body 21, engages the at least one engaging arm 114 to hold the grinding tray 20 with the outer cover 10, and each one of the at least one engaging element 22 has an engaging hook 221. The engaging hook 221 may be inverted-L-shaped, is formed on and protrudes from the top side of the connecting board 212, and is formed with the external surface of the tube seat 211. The engaging hook 221 of the at least one engaging element 22 engages the engaging recess 115 of the at least one engaging arm 114 to connect the body 21 securely with the casing 11.

Preferably, the grinding tray 20 has three engaging hooks 221 formed on and protruding from the connecting board 212 at intervals and respectively engaging the three engaging arms 114 of the casing 11. In addition, the grinding tray 20 further has a mounting recess 223, an abutting post 222 and a spring 224. The mounting recess 223 is formed in a top side of one of the engaging hooks 221. The abutting post 222 is movably mounted in the mounting recess 223, selectively abuts against the casing 11 via the at least one engaging hole 113, and has an outer end and an inner end. The outer end of the abutting post 222 selectively extends into the at least one engaging hole 113 and abuts against the casing 11. The inner end of the abutting post 222 is mounted in the mounting recess 223. The spring 224 is mounted in the mounting recess 223 and abuts the inner end of the abutting post 222 to enable the abutting post 222 to move upwardly or downwardly relative to the corresponding engaging hook 221. Preferably, the abutting post 222 and the spring 224 are connected to the corresponding engaging hook 221 by injection molding.

The grinding element 30 is detachably connected to the grinding tray 20 below the outer cover 10. Preferably, the grinding element 30 is connected to the connecting board 212 of the body 21 by glue or a Velcro strap. Furthermore, according to different processing methods, the grinding element 30 can be a non-woven fabric, a fabric, a sand paper, an abrasive sponge or a black corundum flannel.

Figure 7:
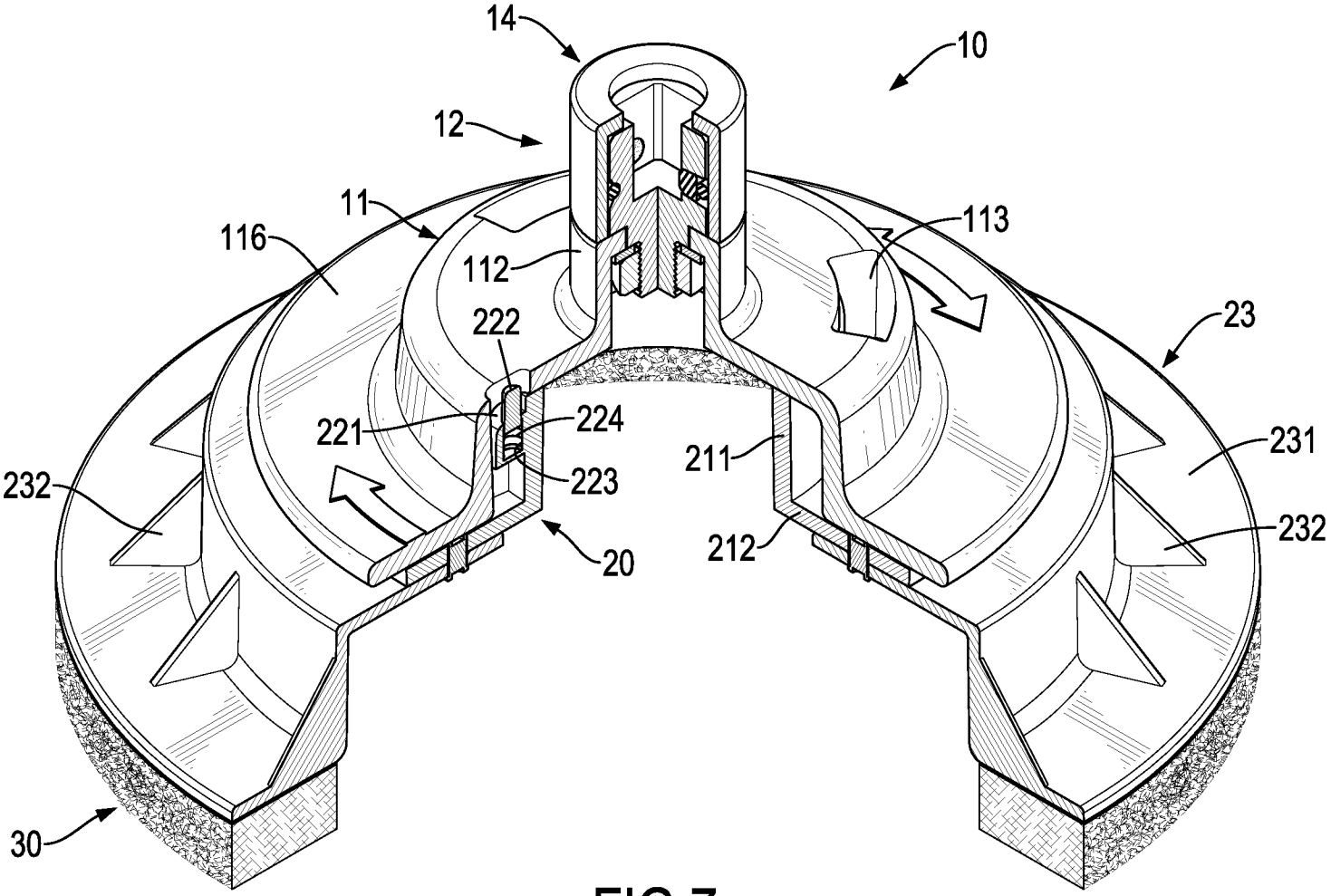
FIG. 7 is a perspective sectional view of a second embodiment of a grinding-disc device for power tools in accordance with the present invention.
Figure 8:
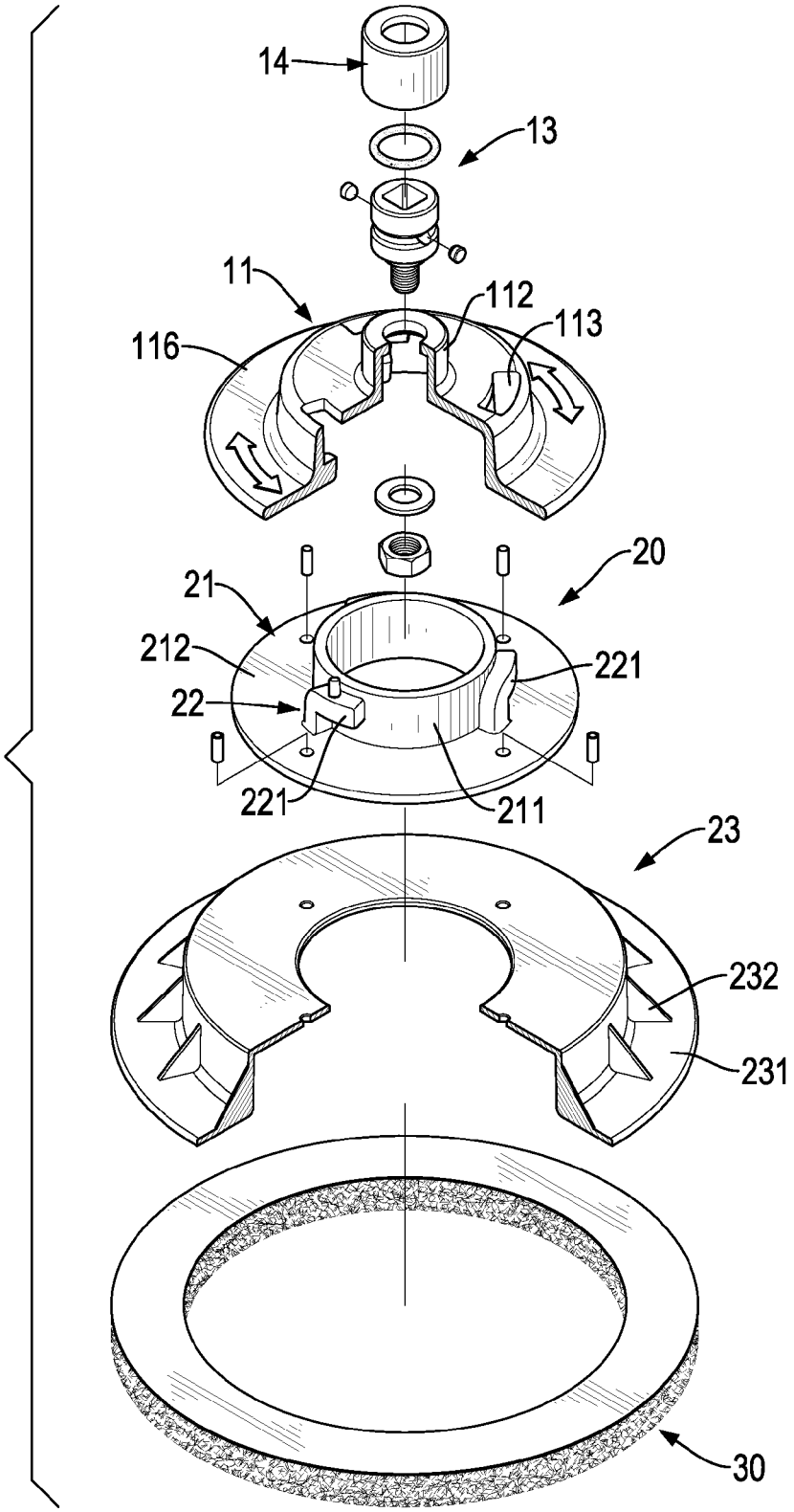
FIG. 8 is an exploded perspective view of the grinding-disc device in FIG. 7.
Figure 9:
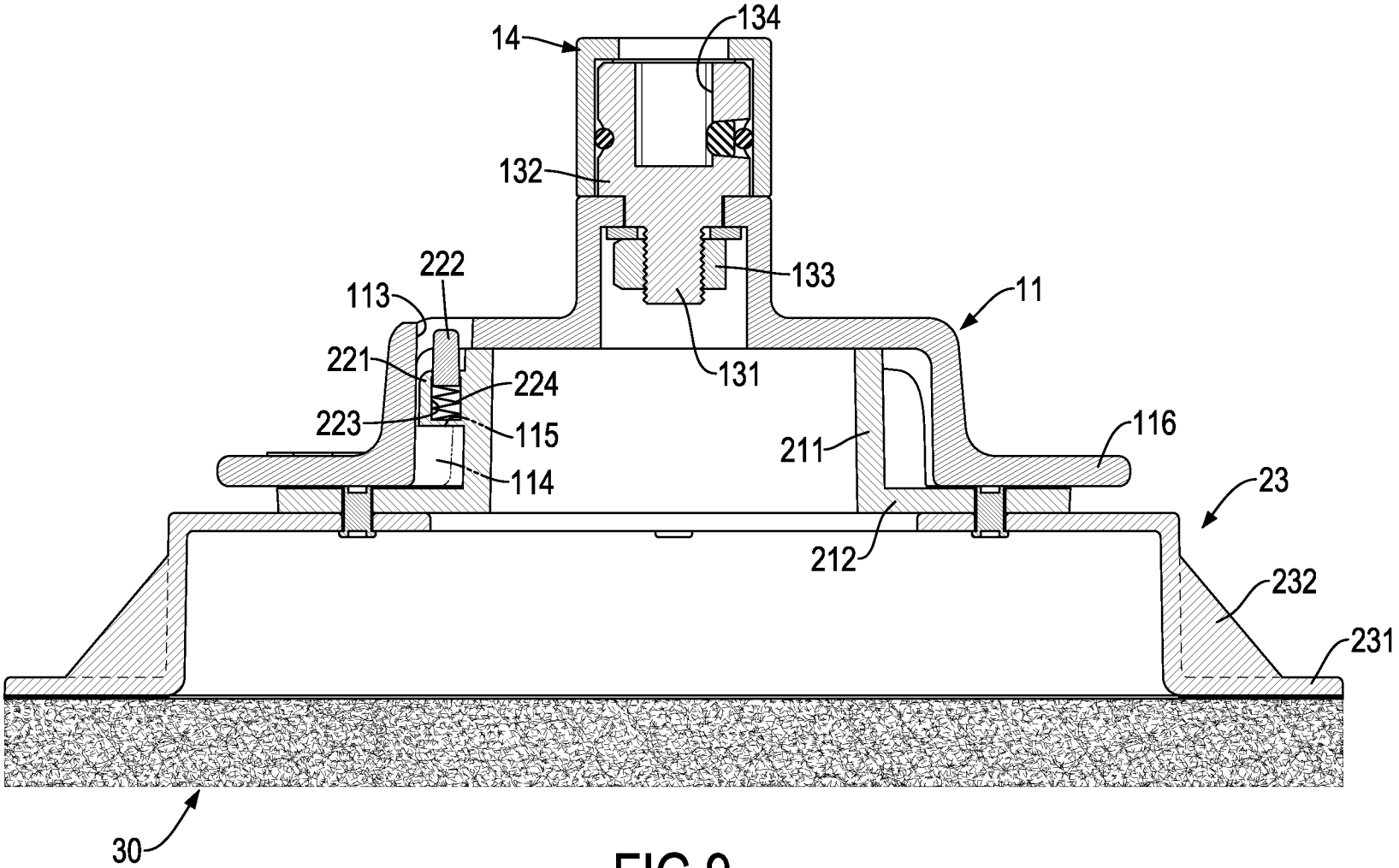
FIG. 9 is a cross sectional side view of the grinding-disc device in FIG. 7.

With reference to FIGS. 7 to 9, a second embodiment of a grinding-disc device for power tools in accordance with the present invention has a similar structure as the first embodiment. The difference between the second embodiment and the first embodiment is the grinding tray 20 and the grinding element 30. In the second embodiment, the grinding tray 20 further has a linking plate 23. The linking plate 23 is connected to the connecting board 212 of the body 21 by screwing or riveting and has an open bottom, a linking board 231 and multiple reinforcing ribs 232. The linking board 231 is radially formed on and protrudes from the open bottom of the linking plate 23, extends out of the connecting board 212 and the casing 11, and has a top side. The reinforcing ribs 232 are formed on and protrude from the top side of the linking board 231 at intervals. The grinding element 30 is connected to the linking board 231 of the linking plate 23 below the outer cover 10.

Figure 5:
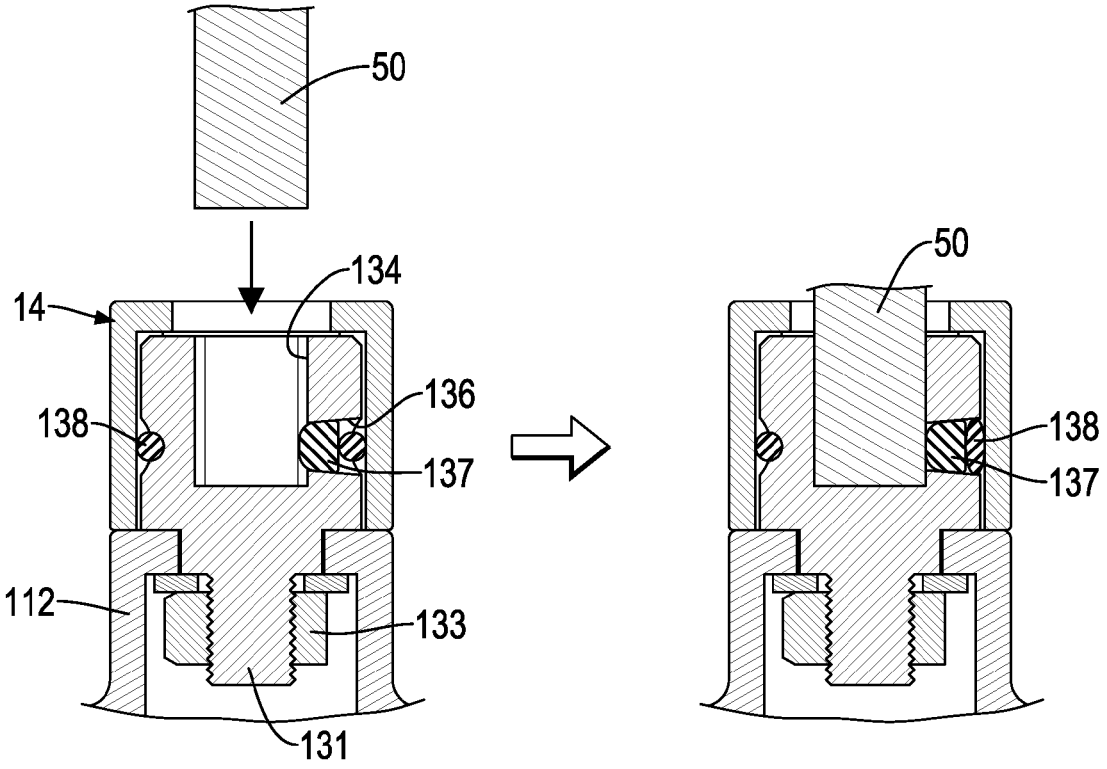
FIG. 5 is an enlarged operational side view of the grinding-disc device in FIG. 1, connected to a driving shaft.

With reference to FIGS. 2 and 5, in use, the grinding tray 20 can be rotated relative to the outer cover 10 to enable the engaging hooks 221 to respectively engage in the engaging recesses 115 of the engaging arms 114, and this can enable the grinding tray 20 to securely connect with the outer cover 10. After the grinding tray 20 is connected with the outer cover 10, a driving shaft 50 of a power tool can be inserted into the connecting recess 134 of the connecting barrel 312 via the mounting lid 14. When the driving shaft 50 is inserted into the connecting recess 134, the clamping elements 137 will be pushed outwardly relative to the connecting barrel 132 by the driving shaft 50. Then, the elastic ring 138 will be deformed by an extrusion that is formed between the mounting lid 14 and the clamping elements 137. At the same time, the clamping elements 137 are also pushed to abut against the driving shaft 50 by the deformed elastic ring 138. Therefore, the driving shaft 50 can be securely connected to the outer cover 10, and this can prevent the mounting tube 12 from separating from the driving shaft 50 when the power tool is operated during a high-torque condition, thereby enhancing safety in use. In addition, the engagement between the engaging elements 22 of the grinding tray 20 and the engaging arms 114 of the casing 11 can prevent the grinding tray 20 from separating from the outer cover 10 when the outer cover 10 is rotated with the driving shaft 50.

Figure 6:
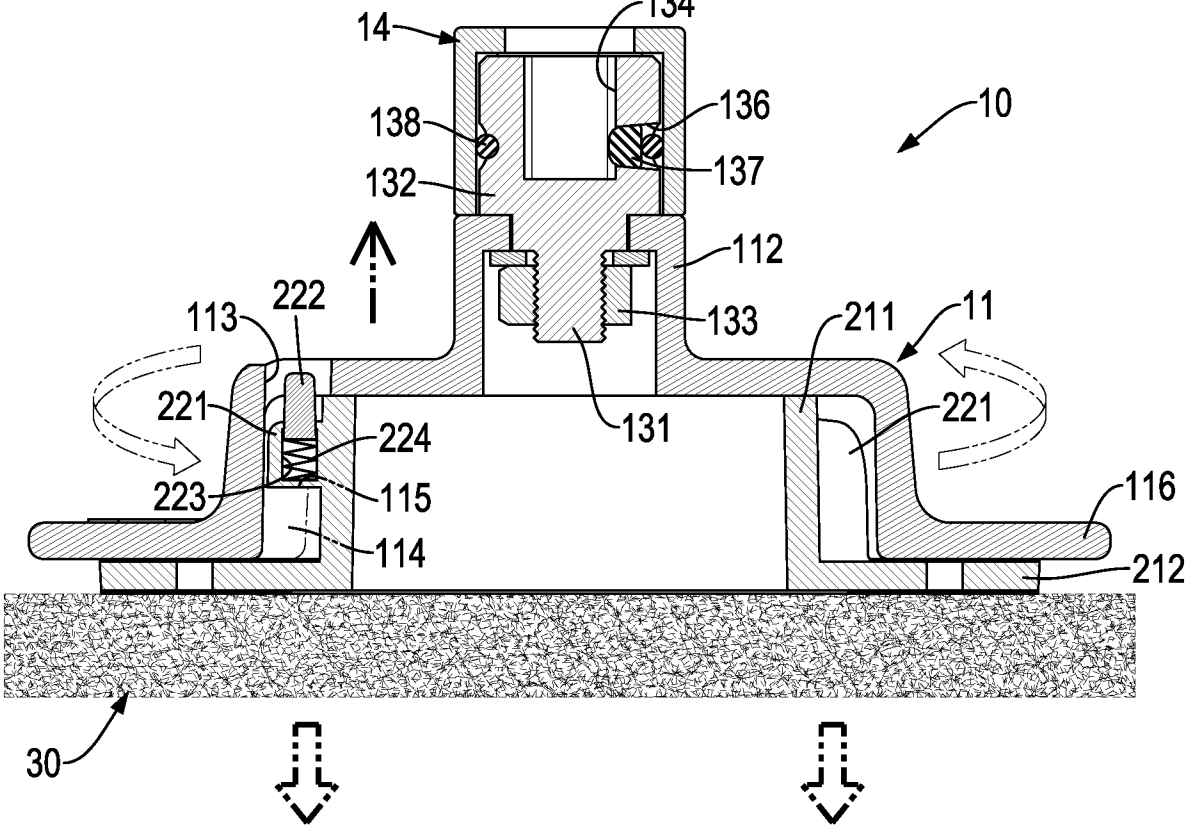
FIG. 6 is an enlarged operational side view of the grinding-disc device in FIG. 1, with a grinding tray rotated relative to the outer cover.

Furthermore, with reference to FIG. 6, when a user wants to grind or polish a workpiece of another different size or shape by the grinding-disc device in accordance with the present invention, the user can rotate the grinding tray 20 in an opposite direction relative to the outer cover 10 to separate the grinding tray 20 from the outer cover 10, and replace the grinding tray 20 of the first embodiment with the grinding tray 20 of the second embodiment as shown in FIGS. 7 to 9 to connect with the outer cover 10. Then, the grinding element 30 that is mounted on the linking plate 23 can be used to grind or polish the workpiece of different sizes or shapes conveniently. Therefore, the user can easily and conveniently change between the grinding trays 20 of the two embodiments in accordance with the present invention to grind or polish the workpiece of different sizes or shapes, and this can reduce the cost of using the grinding-disc device and can improve the applicability of the grinding-disc device.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A grinding-disc device for power tools having:
- an outer cover having
  - a casing having
    - an open bottom;
    - a closed top;
    - a center;
    - an outer periphery;
    - an internal surface;
    - a chamber formed in the casing between the open bottom and the closed top of the casing and communicating with the open bottom of the casing;
    - a connecting tube formed on and protruding from the closed top of the casing at the center of the casing, communicating with the chamber and having a top end;
    - at least one engaging hole formed through the closed top of the casing and communicating with the chamber; and
    - at least one engaging arm formed on and protruding from the internal surface of the casing near the open bottom of the casing; and
  - a mounting tube connected to the connecting tube of the casing;
- a grinding tray detachably connected to the outer cover and having
  - a body mounted below the casing and having
    - a tube seat mounted in the chamber via the open bottom of the casing and having
      - a top end abutting the closed top of the casing;
      - a bottom end; and
      - an external surface; and
    - a connecting board radially formed around the external surface of the tube seat at the bottom end of the tube seat and having a top side; and
  - at least one engaging element formed on the body, engaging the at least one engaging arm to hold the grinding tray with the outer cover, and each one of the at least one engaging element having an engaging hook engaging the at least one engaging arm; and
- a grinding element detachably connected to the grinding tray below the outer cover.

2. The grinding-disc device as claimed in claim 1, wherein the grinding element is connected to the connecting board of the body of the grinding tray.

3. The grinding-disc device as claimed in claim 2, wherein the mounting tube has
- a mounting head connected to the connecting tube of the casing and having
  - a connecting rod extending into the connecting tube and having
    - a top end;
    - a lower end extending into the connecting tube; and
    - a fastener mounted around the connecting rod and abutting against the connecting tube to connect the connecting rod with the connecting tube; and
  - a connecting barrel formed on and axially protruding from the top end of the connecting rod, mounted above the connecting tube, and having
    - a top end;
    - an external surface;
    - a connecting recess axially formed in the top end of the connecting barrel;
    - an annular groove formed in the external surface of the connecting barrel;
    - at least two tapered holes radially formed through the external surface of the connecting barrel in the annular groove, communicating with the connecting recess, and each one of the at least two tapered holes having a clamping element mounted in the tapered hole and extending into the connecting recess; and
    - an elastic ring mounted in the annular groove and abutting the clamping elements to hold the clamping elements in the at least two tapered holes to extend into the connecting recess; and
- a mounting lid mounted around the connecting barrel of the mounting head, abutting the top end of the connecting tube, and having an internal surface abutting the elastic ring to hold the elastic ring between the mounting lid and the clamping elements the at least two tapered holes.

4. The grinding-disc device as claimed in claim 3, wherein the casing has
- three engaging holes formed through the closed top of the casing around the connecting tube at intervals; and
- three engaging arms formed on and protruding from the internal surface of the casing near the open bottom of the casing, and each one of the engaging arms having an engaging recess formed in the internal surface of the casing and aligning with one of the engaging holes; and the grinding tray has three engaging hooks formed on and protruding from the connecting board at intervals and respectively engaging the engaging recesses of the three engaging arms of the casing.

5. The grinding-disc device as claimed in claim 4, wherein the grinding tray has
- a mounting recess formed in a top side of a corresponding one of the engaging hooks;
- an abutting post movably mounted in the mounting recess, selectively abutting against the casing via a corresponding one of the engaging holes that aligns with the corresponding engaging hook, and having
  - an outer end selectively extending into the corresponding engaging hole and abutting against the casing; and
  - an inner end mounted in the mounting recess; and
- a spring mounted in the mounting recess and abutting the inner end of the abutting post to enable the abutting post to move upwardly or downwardly relative to the corresponding engaging hook.

6. The grinding-disc device as claimed in claim 5, wherein
the casing has an extending panel radially formed around the outer periphery of the casing near the open bottom of the casing; and
the connecting board abuts the extending panel of the casing.

7. The grinding-disc device as claimed in claim 1, wherein
the grinding tray has a linking plate connected to the connecting board of the body;
the linking plate has an open bottom and a linking board radially formed on and protruding from the open bottom of the linking plate, extending out of the connecting board and the casing, and having a top side; and
the grinding element is connected to the linking board of the linking plate below the outer cover.

8. The grinding-disc device as claimed in claim 7, wherein the linking plate has multiple reinforcing ribs formed on and protruding from the top side of the linking board at intervals.

9. The grinding-disc device as claimed in claim 8, wherein the mounting tube has
a mounting head connected to the connecting tube of the casing and having
a connecting rod extending into the connecting tube and having
a top end;
a lower end extending into the connecting tube; and
a fastener mounted around the connecting rod and abutting against the connecting tube to connect the connecting rod with the connecting tube; and
a connecting barrel formed on and axially protruding from the top end of the connecting rod, mounted above the connecting tube, and having
a top end;
an external surface;
a connecting recess axially formed in the top end of the connecting barrel;
an annular groove formed in the external surface of the connecting barrel;
at least two tapered holes radially formed through the external surface of the connecting barrel in the annular groove, communicating with the connecting recess, and each one of the at least two tapered holes having a clamping element mounted in the tapered hole and extending into the connecting recess; and
an elastic ring mounted in the annular groove and abutting the clamping elements to hold the clamping elements in the at least two tapered holes to extend into the connecting recess; and
a mounting lid mounted around the connecting barrel of the mounting head, abutting the top end of the connecting tube, and having an internal surface abutting the elastic ring to hold the elastic ring between the mounting lid and the clamping elements the at least two tapered holes.

10. The grinding-disc device as claimed in claim 9, wherein
the casing has
three engaging holes formed through the closed top of the casing around the connecting tube at intervals; and
three engaging arms formed on and protruding from the internal surface of the casing near the open bottom of the casing, and each one of the engaging arms having an engaging recess formed in the internal surface of the casing and aligning with one of the engaging holes; and
the grinding tray has three engaging hooks formed on and protruding from the connecting board at intervals and respectively engaging the engaging recesses of the three engaging arms of the casing.

11. The grinding-disc device as claimed in claim 10, wherein the grinding tray has
a mounting recess formed in a top side of a corresponding one of the engaging hooks;
an abutting post movably mounted in the mounting recess, selectively abutting against the casing via a corresponding one of the engaging holes that aligns with the corresponding engaging hook, and having
an outer end selectively extending into the corresponding engaging hole and abutting against the casing; and
an inner end mounted in the mounting recess; and
a spring mounted in the mounting recess and abutting the inner end of the abutting post to enable the abutting post to move upwardly or downwardly relative to the corresponding engaging hook.

12. The grinding-disc device as claimed in claim 11, wherein
the casing has an extending panel radially formed around the outer periphery of the casing near the open bottom of the casing; and
the connecting board abuts the extending panel of the casing.

13. The grinding-disc device as claimed in claim 7, wherein the mounting tube has
a mounting head connected to the connecting tube of the casing and having
a connecting rod extending into the connecting tube and having
a top end;
a lower end extending into the connecting tube; and
a fastener mounted around the connecting rod and abutting against the connecting tube to connect the connecting rod with the connecting tube; and
a connecting barrel formed on and axially protruding from the top end of the connecting rod, mounted above the connecting tube, and having
a top end;
an external surface;
a connecting recess axially formed in the top end of the connecting barrel;
an annular groove formed in the external surface of the connecting barrel;
at least two tapered holes radially formed through the external surface of the connecting barrel in the annular groove, communicating with the connecting recess, and each one of the at least two tapered holes having a clamping element mounted in the tapered hole and extending into the connecting recess; and
an elastic ring mounted in the annular groove and abutting the clamping elements to hold the clamping elements in the at least two tapered holes to extend into the connecting recess; and
a mounting lid mounted around the connecting barrel of the mounting head, abutting the top end of the connecting tube, and having an internal surface abutting the elastic ring to hold the elastic ring between the mounting lid and the clamping elements of the at least two tapered holes.

14. The grinding-disc device as claimed in claim 13, wherein the casing has three engaging holes formed through the closed top of the casing around the connecting tube at intervals; and three engaging arms formed on and protruding from the internal surface of the casing near the open bottom of the casing, and each one of the engaging arms having an engaging recess formed in the internal surface of the casing and aligning with one of the engaging holes; and the grinding tray has three engaging hooks formed on and protruding from the connecting board at intervals and respectively engaging the engaging recesses of the three engaging arms of the casing.

15. The grinding-disc device as claimed in claim 14, wherein the grinding tray has a mounting recess formed in a top side of a corresponding one of the engaging hooks;

an abutting post movably mounted in the mounting recess, selectively abutting against the casing via a corresponding one of the engaging holes that aligns with the corresponding engaging hook, and having an outer end selectively extending into the corresponding engaging hole and abutting against the casing; and an inner end mounted in the mounting recess; and a spring mounted in the mounting recess and abutting the inner end of the abutting post to enable the abutting post to move upwardly or downwardly relative to the corresponding engaging hook.

16. The grinding-disc device as claimed in claim 15, wherein the casing has an extending panel radially formed around the outer periphery of the casing near the open bottom of the casing; and the connecting board abuts the extending panel of the casing.

17. The grinding-disc device as claimed in claim 1, wherein the mounting tube has a mounting head connected to the connecting tube of the casing and having a connecting rod extending into the connecting tube and having a top end;

a lower end extending into the connecting tube; and a fastener mounted around the connecting rod and abutting against the connecting tube to connect the connecting rod with the connecting tube; and a connecting barrel formed on and axially protruding from the top end of the connecting rod, mounted above the connecting tube, and having a top end;

an external surface;

a connecting recess axially formed in the top end of the connecting barrel;

an annular groove formed in the external surface of the connecting barrel;

at least two tapered holes radially formed through the external surface of the connecting barrel in the annular groove, communicating with the connecting recess, and each one of the at least two tapered holes having a clamping element mounted in the tapered hole and extending into the connecting recess; and an elastic ring mounted in the annular groove and abutting the clamping elements to hold the clamping elements in the at least two tapered holes to extend into the connecting recess; and a mounting lid mounted around the connecting barrel of the mounting head, abutting the top end of the connecting tube, and having an internal surface abutting the elastic ring to hold the elastic ring between the mounting lid and the clamping elements of the at least two tapered holes.

18. The grinding-disc device as claimed in claim 17, wherein the casing has three engaging holes formed through the closed top of the casing around the connecting tube at intervals; and three engaging arms formed on and protruding from the internal surface of the casing near the open bottom of the casing, and each one of the engaging arms having an engaging recess formed in the internal surface of the casing and aligning with one of the engaging holes; and the grinding tray has three engaging hooks formed on and protruding from the connecting board at intervals and respectively engaging the engaging recesses of the three engaging arms of the casing.

19. The grinding-disc device as claimed in claim 18, wherein the grinding tray has a mounting recess formed in a top side of a corresponding one of the engaging hooks;

an abutting post movably mounted in the mounting recess, selectively abutting against the casing via a corresponding one of the engaging holes that aligns with the corresponding engaging hook, and having an outer end selectively extending into the corresponding engaging hole and abutting against the casing; and an inner end mounted in the mounting recess; and a spring mounted in the mounting recess and abutting the inner end of the abutting post to enable the abutting post to move upwardly or downwardly relative to the corresponding engaging hook.

20. The grinding-disc device as claimed in claim 19, wherein the casing has an extending panel radially formed around the outer periphery of the casing near the open bottom of the casing; and the connecting board abuts the extending panel of the casing.

* * * * *